US010163416B2

(12) United States Patent
Lin et al.

(10) Patent No.: US 10,163,416 B2
(45) Date of Patent: Dec. 25, 2018

(54) DISPLAY APPARATUS AND DRIVING METHOD THEREOF

(71) Applicant: Novatek Microelectronics Corp., Hsinchu (TW)

(72) Inventors: Chieh-An Lin, Taipei (TW); Jhih-Siou Cheng, New Taipei (TW); Po-Hsiang Fang, Hsinchu (TW); Po-Yu Tseng, Taoyuan (TW); Ju-Lin Huang, Hsinchu County (TW); Yi-Chuan Liu, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 150 days.

(21) Appl. No.: 14/801,855

(22) Filed: Jul. 17, 2015

(65) Prior Publication Data

US 2017/0018242 A1 Jan. 19, 2017

(51) Int. Cl.
*G09G 3/36* (2006.01)

(52) U.S. Cl.
CPC ... *G09G 3/3688* (2013.01); *G09G 2310/0251* (2013.01)

(58) Field of Classification Search
CPC ..... G09G 3/3677; G09G 3/3688; G09G 2310/0205; G09G 2310/0251; G09G 2320/02
USPC ..... 345/87, 96, 103, 204, 209, 212
See application file for complete search history.

(56) References Cited

U.S. PATENT DOCUMENTS

| | | | | |
|---|---|---|---|---|
| 7,502,008 | B2 | 3/2009 | Jeoung et al. | |
| 7,773,084 | B2 | 8/2010 | Itakura et al. | |
| 8,269,709 | B2 | 9/2012 | Jeoung et al. | |
| 8,994,707 | B2 | 3/2015 | Kim et al. | |
| 9,460,680 | B2 | 10/2016 | Ito | |
| 2004/0164976 | A1* | 8/2004 | Nakamura | G09G 3/3648 345/204 |
| 2005/0243043 | A1 | 11/2005 | Jeoung et al. | |

(Continued)

FOREIGN PATENT DOCUMENTS

| | | |
|---|---|---|
| CN | 1664910 | 9/2005 |
| CN | 1693942 | 11/2005 |

(Continued)

OTHER PUBLICATIONS

"Office Action of Taiwan Counterpart Application", dated Jun. 22, 2016, p. 1-p. 6.

(Continued)

*Primary Examiner* — Stacy Khoo
(74) *Attorney, Agent, or Firm* — JCIPRNET

(57) ABSTRACT

A display apparatus and a driving method of the same are provided. The display apparatus includes a display panel, a gate driver circuit, and a source driver circuit. During a functional sub-period of a frame period, the gate driver circuit simultaneously drives a plurality of gate lines, and the source driver circuit drives a plurality of source lines, so as to perform a function on a plurality of pixels connected to the gate lines. In a scan sub-period of the frame period, the gate driver circuit drives the gate lines according to a scan sequence, and the source driver circuit correspondingly drives the source lines according to the scan sequence of the gate driver circuit in the first scan sub-period, so as to display an image.

7 Claims, 7 Drawing Sheets

(56) References Cited

U.S. PATENT DOCUMENTS

| | | | | |
|---|---|---|---|---|
| 2006/0077157 | A1 | 4/2006 | Arimoto et al. | |
| 2008/0136810 | A1 | 6/2008 | Itakura et al. | |
| 2009/0135122 | A1 | 5/2009 | Jeoung et al. | |
| 2012/0056917 | A1* | 3/2012 | Ito | G09G 3/3614 345/691 |
| 2013/0169616 | A1* | 7/2013 | Kim | G09G 3/20 345/212 |
| 2014/0160184 | A1 | 6/2014 | Wang | |
| 2016/0358578 | A1 | 12/2016 | Ito | |

FOREIGN PATENT DOCUMENTS

| | | | | |
|---|---|---|---|---|
| CN | 1871633 | | 11/2006 | |
| CN | 1932936 | | 3/2007 | |
| CN | 102385846 | | 3/2012 | |
| CN | 103165063 | A * | 6/2013 | |
| CN | 103187023 | | 7/2013 | |
| JP | WO 2013042622 | A1 * | 3/2013 | G09G 3/3614 |
| TW | 201025255 | | 7/2010 | |
| TW | 201324479 | | 6/2013 | |
| WO | 2013042622 | | 3/2013 | |

OTHER PUBLICATIONS

"Office Action of China Counterpart Application", dated Jun. 1, 2018, p. 1-p. 9.

* cited by examiner

DISPLAY APPARATUS AND DRIVING METHOD THEREOF

FIELD OF THE INVENTION

The invention relates to an electronic apparatus. More particularly, the invention relates to a display apparatus and a driving method thereof

DESCRIPTION OF RELATED ART

FIG. 1 is a schematic block view illustrating circuitry of a display panel. The display panel 100 is constituted by two substrates, and liquid crystal materials are sandwiched by the two substrates, so as to form a liquid crystal display (LCD) layer. The display panel 100 has a plurality of source lines (e.g., source lines S1, S2, S3, and S4 shown in FIG. 1, also referred to as data lines), a plurality of gate lines (e.g., gate lines G1, G2, G3, and G4 shown in FIG. 1, also referred to as scan lines), and a plurality of pixels (e.g., pixels P(1,1), P(1,2), P(1,3), P(1,4), P(2,1), P(2,2), P(2,3), P(2,4), P(3,1), P(3,2), P(3,3), P(3,4), P(4,1), P(4,2), P(4,3), and P(4,4) shown in FIG. 1). The source lines S1-S4 are perpendicular to the gate lines G1-G4. The pixels P(1,1)-P(4,4) are arranged in a matrix on the display panel 100 FIG. 1 shows the circuitry of pixels P(1,1)-P(4,1), and the circuitry of other pixels can be deduced from FIG. 1.

In a conventional LCD, the gate lines of the LCD panel are often scanned in a constant order. FIG. 2 is a schematic view illustrating waveforms of signals of the display panel 100 depicted in FIG. 1. In FIG. 2, the horizontal axis represents time. In one frame period Fl, a gate driver may output a scan signal to the gate lines G1-G4 of the display panel 100 according to a scan sequence, so as to drive each of the gate lines G1-G4 one by one in turns in the constant order. In general, the gate line G1 is driven first, and the gate lines G2, G3, and G4 are sequentially driven. The time length during which each of the gate lines G1-G4 is driven is TL1. According to the scan sequence of scanning the gate lines G1-G4 by the gate driver (not shown), a source driver (not shown) may write row data into the pixels P(1,1)-P(4,4) of the display panel 100 through the source lines S1-S4, so as to display an image.

However, in a conventional driver chip of the display panel 100, if any special function (e.g., a pre-charging function) is to be added to the timing budget, additional time is required. For instance, FIG. 3 is a schematic view illustrating waveforms of signals of the display panel 100 depicted in FIG. 1 after the pre-charging function is additionally performed. In FIG. 3, the horizontal axis represents time. In order to perform the additional pre-charging function, the time length TL1 of driving each of the gate lines G1-G4 is required to be divided into a pre-charging period TF1 and a data driving period TL2. Apparently, the effective time length TL1 of writing the row data into the display panel 100 by the source driver (not shown) through the source lines S1-S4 is significantly reduced to TL2. Given that the frame rate stays unchanged, the time spent on charging the pixels is reduced as long as the pre-charging function is performed, which reduces the image contrast and lessens the image quality.

SUMMARY OF THE INVENTION

The invention is directed to a display apparatus and a driving method thereof; by way of new time allocation, the sacrifice of the charging time of pixels can be reduced although additional functions may be performed.

In an embodiment of the invention, a display apparatus is provided. The display apparatus includes a display panel, a gate driver circuit, and a source driver circuit. The display panel has a plurality of gate lines and a plurality of source lines. Output terminals of the gate driver circuit are coupled to the gate lines in a one-on-one manner. The gate driver circuit simultaneously drives the gate lines during a functional sub-period of a frame period, so as to turn on a plurality of pixels connected to the gate lines, and the gate driver circuit drives the gate lines according to a scan sequence in a scan sub-period of the frame period. Output terminals of the source driver circuit are coupled to the source lines in a one-on-one manner. The source driver circuit drives the source lines during the functional sub-period, so as to perform a function on the pixels connected to the gate lines, and the source driver circuit correspondingly drives the source lines according to the scan sequence of the gate driver circuit in the scan sub-period, so as to display an image.

In an embodiment of the invention, a driving method of a display apparatus is provided. The driving method includes: simultaneously driving a plurality of gate lines of a display panel in a functional sub-period of a frame period, so as to turn on a plurality of pixels connected to the gate lines; driving a plurality of source lines of the display panel in the functional sub-period, so as to perform a function on the pixels connected to the gate lines; driving the gate lines during a scan sub-period of the frame period according to a scan sequence; correspondingly driving the source lines according to the scan sequence in the scan sub-period, so as to display an image.

In view of the above, the driving apparatus and the driving method thereof as provided herein allow additional functions (e.g., a pre-charging function, a charge-sharing function, and so on) to be simultaneously performed on different pixels connected to the gate lines in the functional sub-period of the frame period, such that the sacrifice of the time spent on charging the pixels is reduced even though the additional functions are performed during the frame period, and that the image contrast and the image quality can both be enhanced.

Several exemplary embodiments accompanied with figures are described in detail below to further describe the invention in details.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
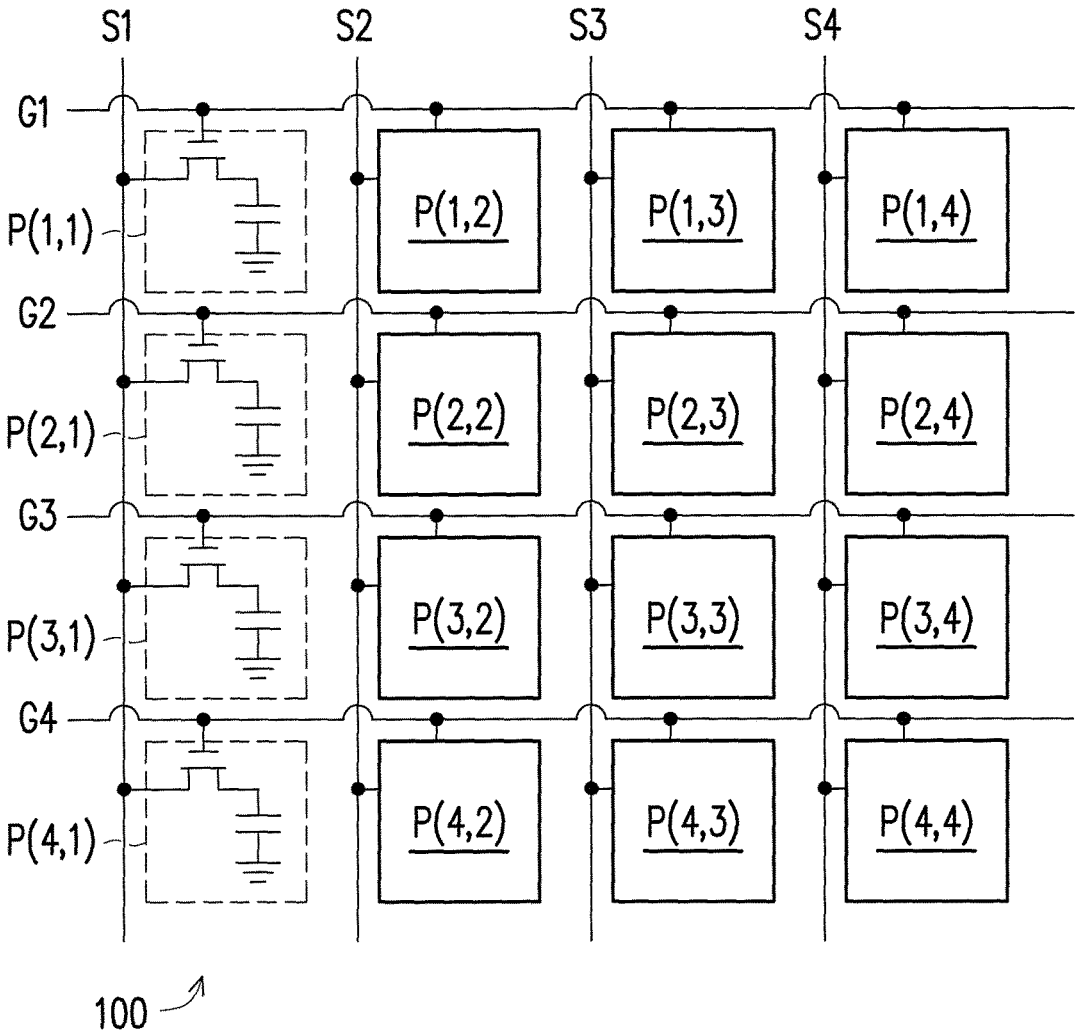
FIG. 1 (RELATED ART)
FIG. 1 is a schematic block view illustrating circuitry of a display panel.
Figure 2:
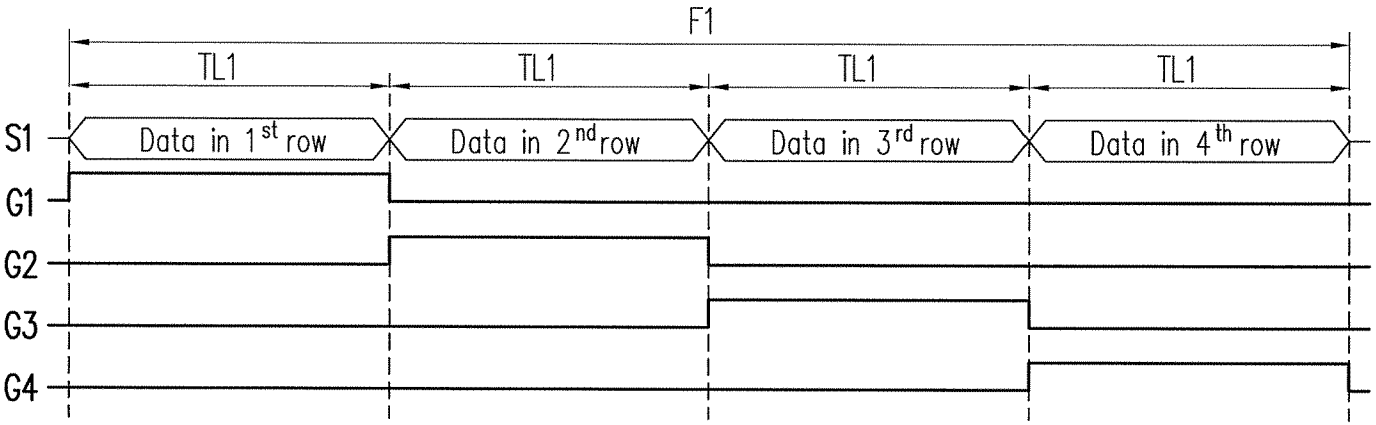
FIG. 2 (RELATED ART)
FIG. 2 is a schematic view illustrating waveforms of signals of the display panel depicted in FIG. 1.

The term "coupled (or connected)" used in this disclosure (including claims) may express any direct or indirect connection means. For instance, "a first apparatus is coupled (or connected) to a second apparatus" should be interpreted as "the first apparatus is directly connected to the second apparatus" or "the first apparatus is indirectly connected to the second apparatus through other apparatuses or connection means." Moreover, wherever appropriate, elements/components/steps with the same reference numerals in the drawings and embodiments represent the same or similar parts. Elements/components/steps with the same reference numerals or names in different embodiments may be cross-referenced.

Figure 4:
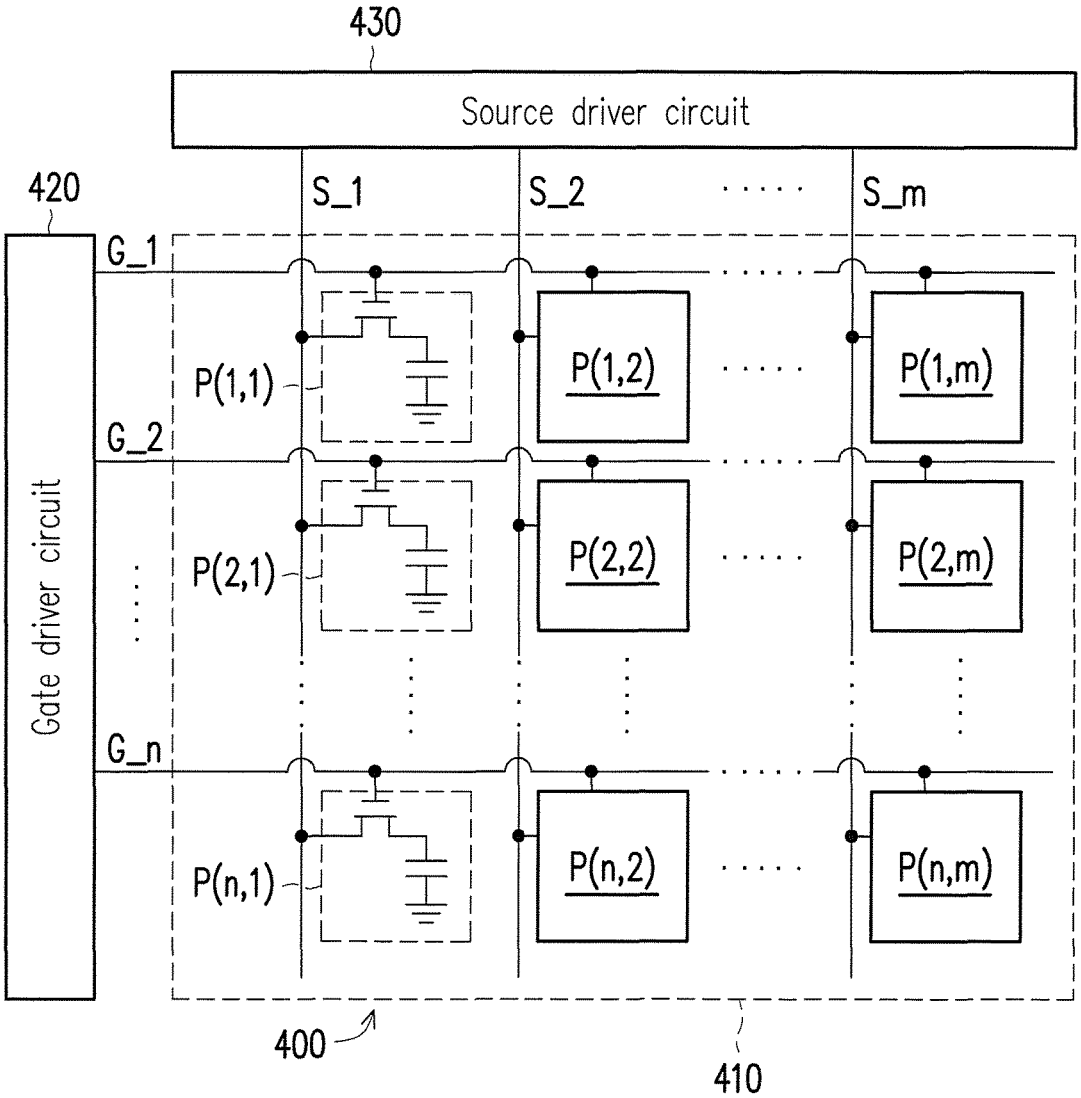
FIG. 4 is schematic block view illustrating circuitry of a display panel according to an embodiment of the invention.

FIG. 4 is schematic block view illustrating circuitry of a display panel 400 according to an embodiment of the invention. The display apparatus 400 includes a display panel 410, a gate driver circuit 420, and a source driver circuit 430. The display panel 410 is constituted by two substrates, and liquid crystal materials are sandwiched by the two substrates, so as to form an LCD layer. The display panel 410 has m source lines (e.g., source lines S_1, S_2, . . . , and S_m shown in FIG. 4, also referred to as data lines), n gate lines (e.g., gate lines G_1, G_2, . . . , and G_n shown in FIG. 4, also referred to as scan lines), and a plurality of pixels (e.g., pixels P(1,1), P(1,2), P(1,m), P(2,1), P(2,2), P(2,m), P(n,1), P(n,2), and P(n,m) shown in FIG. 4). Here, m and n are positive integers. Output terminals of the gate driver circuit 420 are coupled to the gate lines G_1-G_n of the display panel 410 in a one-on-one manner. Output terminals of the source driver circuit 430 are coupled to the source lines S_1-S_m of the display panel 410 in a one-on-one manner. The source lines S_1-S_m are perpendicular to the gate lines G_1-G_n. The pixels P(1,1)-P(n,m) are arranged in a matrix on the display panel 410 FIG. 4 shows the circuitry of pixels P(1,1)-P(n,1), and the circuitry of other pixels can be deduced from FIG. 4.

Figure 5:
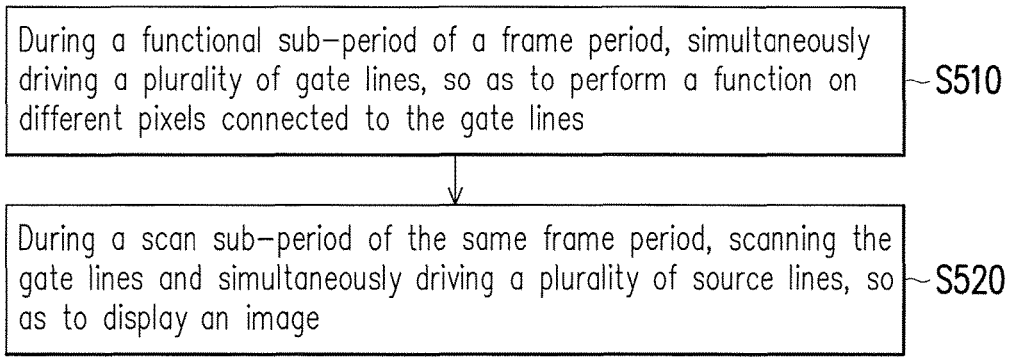
FIG. 5 is schematic flowchart illustrating a driving method of a display apparatus according to an embodiment of the invention.

FIG. 5 is schematic flowchart illustrating a driving method of a display apparatus according to an embodiment of the invention. With reference to FIG. 4 and FIG. 5, in step S510, during a functional sub-period of a frame period, the gate driver circuit 420 can simultaneously drive a plurality of gate lines (e.g., some or all of the gate lines G_1-G_n), so as to turn on a plurality of pixels connected to the gate lines; at the same time, the source driver circuit 430 can drive a plurality of source lines (e.g., some or all of the source lines S_1-S_m), so as to perform a certain function (e.g., a power-saving function, a pre-charging function, a charge-sharing function, or the like) on different pixels connected to the gate lines. Said functions are conducive to the improvement of the efficiency of the driver chip of the display panel 410 or the reduction of power consumption of the display panel 410.

In step S520, during a scan sub-period of the frame period, the gate driver circuit 420 drives the gate lines G_1-G_n of the display panel 410 according to a scan sequence, and the source driver circuit 430 correspondingly drives the source lines S_1-S_m of the display panel 410 according to the scan sequence of the gate driver circuit 420 in the scan sub-period, so as to display an image on the display panel 410.

In view of the above, the driving apparatus 400 and the driving method thereof as provided in the present embodiment allow additional functions (e.g., the pre-charging function, the charge-sharing function, and so on) to be simultaneously performed on different pixels connected to the gate lines in the functional sub-period of the frame period, such that the sacrifice of the time spent on charging the pixels is reduced even though the additional functions are performed during the frame period, and that the image contrast and the image quality can both be enhanced.

In different application scenarios, note that the functions relevant to the gate driver circuit 420 and/or the source driver circuit 430 can be implemented in form of software, firmware, or hardware by normal programming languages (e.g., C or C++), hardware description languages (e.g., Verilog HDL or VHDL), or any other programming language. The software (or firmware) that may execute said relevant functions may be any known computer-accessible media, such as magnetic tapes, semiconductor memories, magnetic disks, compact disks (e.g., CD-ROM or DVD-ROM), etc. Alternatively, the software (or firmware) may be transmitted through Internet, cable communications, wireless communications, or any other communication medium. The software (or firmware) can be stored in accessible media of computers, so as to use the computers to access/execute programming codes of the software (or firmware). In addition, the apparatus and the method provided herein can also be implemented in form of a combination of hardware and software.

Figure 6:
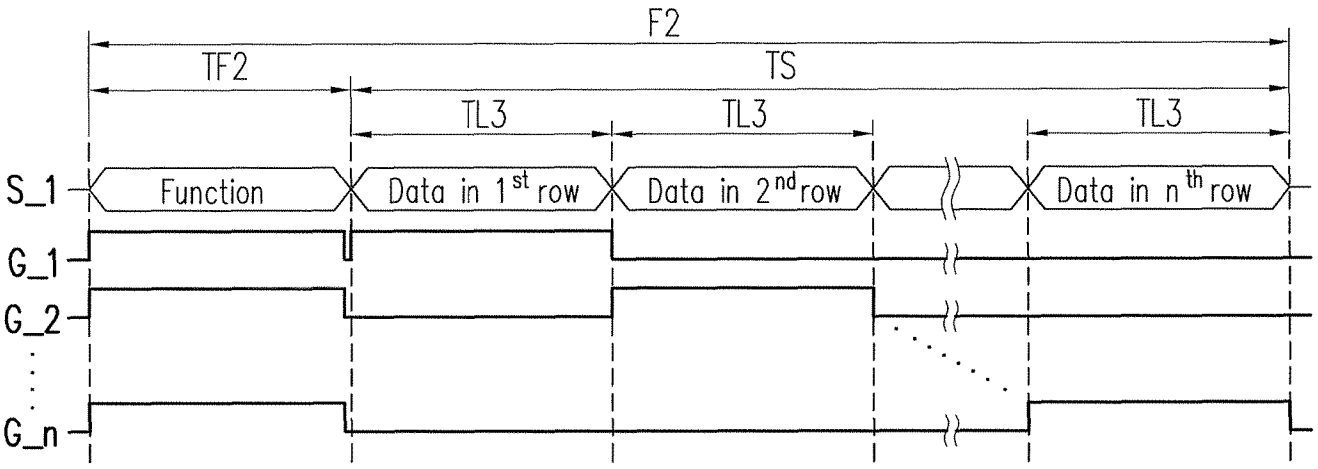
FIG. 6 is a schematic view illustrating waveforms of signals of the display panel depicted in FIG. 4 according to an embodiment of the invention.

FIG. 6 is a schematic view illustrating waveforms of signals of the display panel 410 depicted in FIG. 4 according to an embodiment of the invention. In FIG. 6, the horizontal axis represents time. According to the embodiment shown in FIG. 6, one frame period F2 is divided into a plurality of sub-periods including a functional sub-period TF2 and a scan sub-period TS. In the frame period F2, the functional sub-period TF2 is earlier than the scan sub-period TS. During the functional sub-period TF2 of the frame period F2, the gate driver circuit 420 simultaneously drives a plurality of gate lines (e.g., some or all of the gate lines G_1-G_n), so as to turn on all of the pixels connected to the gate lines. In the same functional sub-period TF2, the source driver circuit 430 can also drive a plurality of source lines (e.g., all of the source lines S_1-S_m), so as to perform a certain function (e.g., the power-saving function, the pre-charging function, the charge-sharing function, and so on) on different pixels connected to the gate lines G_1-G_n.

In the scan sub-period TS of the frame period F2, the gate driver circuit 420 can drive/scan the gate lines G_1-G_n of the display panel 410 according to a certain scan sequence. For instance, the gate line G_1 is driven first, and the gate lines G_2, . . . , and G_n are sequentially driven, as shown in FIG. 6; however, the invention is not limited thereto. The time length during which each of the gate lines G_1-G_n is driven is TL3. In the scan sub-period TS, the source driver circuit 430 correspondingly drives the source lines S_1-S_m of the display panel 410 according to the scan sequence of the gate driver circuit 420, so as to display an image on the display panel 410.

Given that no such an additional function is performed, the original time length during which each of the gate lines G_1-G_n is driven is TL. As long as the additional function is performed, the function (e.g., the power-saving function, the pre-charging function, the charge-sharing function, and so on) requires the functional sub-period TF2 of the frame period F2. Hence, the original time length TL of driving each of the gate lines G_1-G_n is sacrificed by Δt, and thus the actual time length TL3 of driving each of the gate lines G_1-G_n is (TL-Δt). Here, the sacrificed time Δt=TF2/n, and n is the number of the gate lines G_1-G_n. The greater the number n of the gate lines G_1-G__ n is, the less the sacrificed time At of each of the gate lines G_1-G_n is. Hence, according to the display apparatus 400 and the driving method thereof as provided herein, the sacrifice of the charging time of the pixels can be reduced even though the additional function is performed in the frame period F2, and the image contrast and the image quality can both be enhanced.

Figure 3:
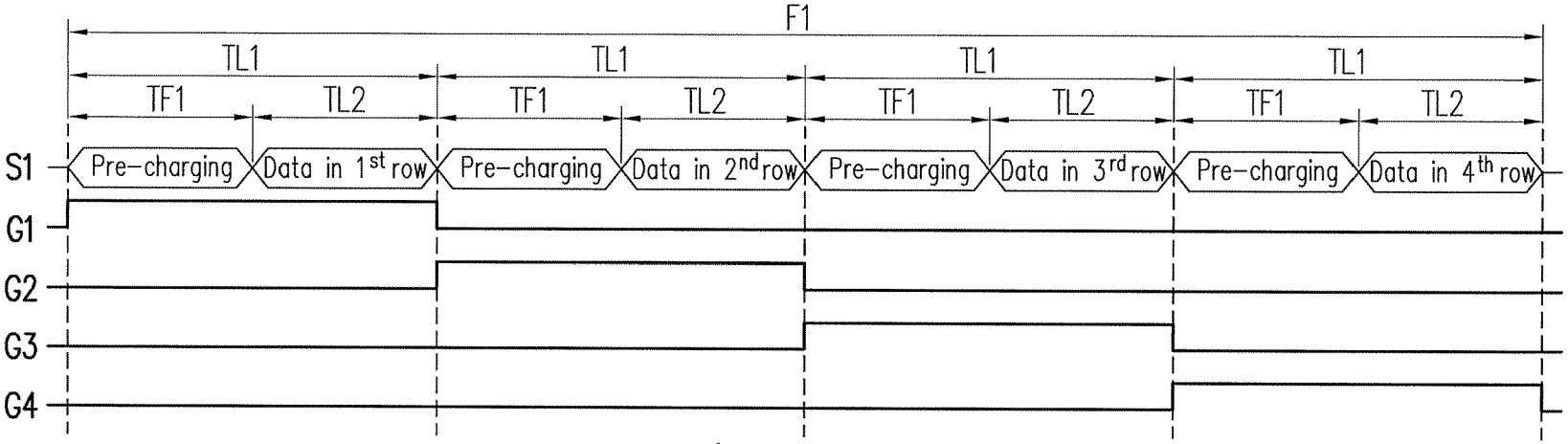
FIG. 3 (RELATED ART)
FIG. 3 is a schematic view illustrating waveforms of signals of the display panel depicted in FIG. 1 after the pre-charging function is added.
Figure 7:
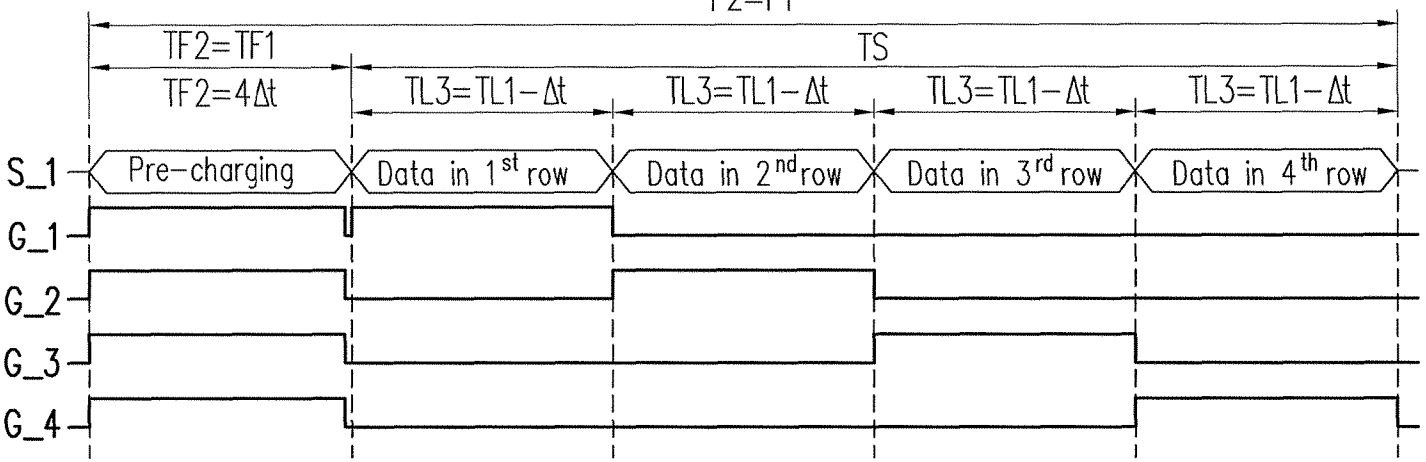
FIG. 7 is a schematic view illustrating the waveforms of the signals of the display panel as depicted in FIG. 6 according to an embodiment of the invention, given that the number of gate lines is 4.

FIG. 7 is a schematic view illustrating the waveform of the signal of the display panel 410 as depicted in FIG. 6 according to an embodiment of the invention, given that the number of gate lines is 4. In FIG. 7, the horizontal axis represents time. In order to make comparisons between FIG. 3 and FIG. 7, the number n of gate lines G_1-G_n in FIG. 7 is 4 according to the present embodiment, and the time length of the frame period F2 in FIG. 7 is equal to the time length of the frame period F1 in FIG. 3. In the embodiment shown in FIG. 7, the time length of the functional sub-period TF2 is assumed to be equal to the time length of the pre-charging period TF1 in FIG. 3; therefore, the effects of pre-charging the display panel 410 in FIG. 7 can be similar to the effects of pre-charging the display panel 100 in FIG. 3. Since the number n of the gate lines G_1-G_n in FIG. 7 is 4, the sacrificed time Δt of each of the gate lines G_1-G_4 is TF2/4, and thus the actual time length TL3 of driving each of the gate lines G_1-G_n is (TL1-Δt)=TL1-(TF2/4)=TL1-(TF1/4). In FIG. 3, the time length TL2 during which each of the gate lines G1-G4 is driven is (TL1-TF1). Compared to FIG. 3, FIG. 7 shows that the sacrifice of the time spent on charging the pixels can be reduced even though the additional function is performed in the frame period, and the image contrast and the image quality can both be enhanced. The greater the number n of the gate lines G_1-G_n is, the less the sacrificed time Δt of each of the gate lines G_1-G_n is.

Figure 8:
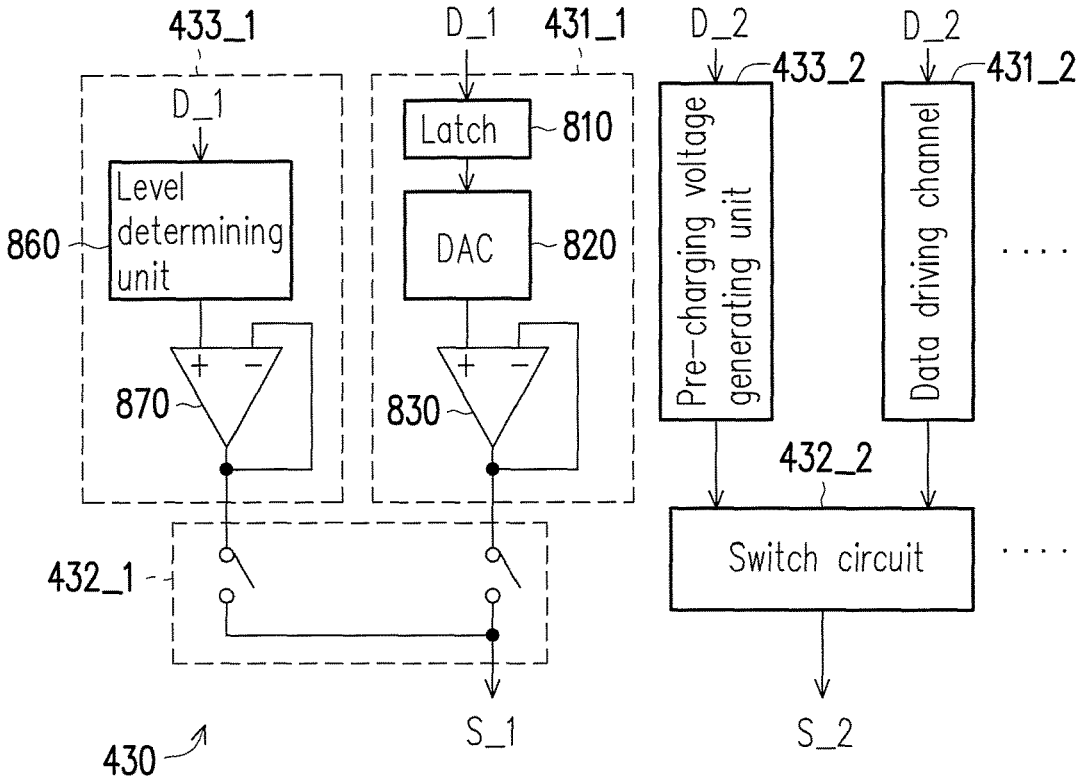
FIG. 8 is schematic block view illustrating the source driver circuit depicted in FIG. 4 according to an embodiment of the invention.

FIG. 8 is schematic block view illustrating the source driver circuit 430 depicted in FIG. 4 according to an embodiment of the invention. The source driver circuit 430 includes a plurality of data driving channels (e.g., the data driving channels 431_1 and 431_2 shown in FIG. 8) and a plurality of switch circuits (e.g., the switch circuits 432_1 and 432_2 shown in FIG. 8). The data driving channel 431_1 includes a latch 810, a digital-to-analog converter (DAC) 820, and an output buffer 830. The DAC 820 is coupled between the latch 810 and the output buffer 830. The latch 810 is configured to latch pixel data D_1 and output the latched data (e.g., the pixel data D_1) to the DAC 820. The DAC 820 is configured to convert the latched data into an analog voltage (corresponding to a pixel voltage) and output the analog voltage to the output buffer 830. The output buffer 830 may contribute to the gain of the pixel voltage correspondingly output by the DAC 820 and output said pixel voltage to the source line S_1 of the display panel 410 through the switch circuit 432_1. Descriptions of other data driving channels (e.g., the data driving channel 4312 shown in FIG. 8) can be deduced from the description of the data driving channel 431_1 and thus will be omitted hereinafter. For instance, the data driving channel 431_2 can latch pixel data D_2, convert the latched data (e.g., the pixel data D_2) into the corresponding pixel voltage, and output the corresponding pixel voltage to the source line S_2 of the display panel 410 through the switch circuit 432_2.

Each of the data driving channels is equipped with a pre-charging voltage generating unit (e.g., pre-charging voltage generating units 433_1 and 433_2 shown in FIG. 8). The pre-charging voltage generating unit 433_1 includes a level determining unit 860 and an output buffer 870. The level determining unit 860 is configured to receive the pixel data D_1 of the data driving channel, dynamically determine and generate a pre-charging voltage according to the pixel data D_1, and output the pre-charging voltage to the output buffer 870. The output buffer 870 is coupled between the level determining unit 860 and the switch circuit 432_1. The output buffer 870 may contribute to the gain of the pre-charging voltage output by the level determining unit 860 and output said pre-charging voltage to the source line S_1 of the display panel 410 through the switch circuit 432_1. Descriptions of other pre-charging voltage generating units (e.g., the pre-charging voltage generating unit 433_2 shown in FIG. 8) can be deduced from the description of the pre-charging voltage generating unit 433_1 and thus will be omitted hereinafter. For instance, the pre-charging voltage generating unit 433_2 can dynamically determine and generate the pre-charging voltage according to the pixel data D_2 and output the pre-charging voltage to the source line S_2 of the display panel 410 through the switch circuit 432_2. Hence, the pre-charging voltages generated by the pre-charging voltage generating units (e.g., the pre-charging voltage generating units 433_1 and 433_2 shown in FIG. 8) of the source driver circuit 430 correspond to the latched data of the data driving channels (e.g., the data driving channels 431_1 and 431_2 shown in FIG. 8). In another embodiment of the invention, the pre-charging voltages generated by the pre-charging voltage generating units (e.g., the pre-charging voltage generating units 433_1 and 433_2 shown in FIG. 8) of the source driver circuit 430 may be constant voltages.

A first input terminal and a second input terminal of the switch circuit 432_1 are respectively coupled to an output terminal of the data driving channel 431_1 and an output terminal of the pre-charging voltage generating unit 433_1. An output terminal of the switch circuit 432_1 is coupled to the source line S_1 of the display panel 410. The switch circuit 432_1 is configured to select to couple the output terminal of the pre-charging voltage generating unit 433_1 to the source line S_1 of the display panel 410 during the functional sub-period TF2 of the frame period F2. Besides, the switch circuit 432_1 is configured to select to couple the output terminal of the data driving channel 431_1 to the source line S_1 of the display panel 410 during the scan sub-period TS of the frame period F2. Descriptions of other switch circuits (e.g., the switch circuit 432_2 shown in FIG. 8) can be deduced from the description of the switch circuit 432_1 and thus will be omitted hereinafter. For instance, the switch circuit 432_2 may select to couple the output terminal of the pre-charging voltage generating unit 433_2 to the source line S_2 of the display panel 410 during the functional sub-period TF2 of the frame period F2 and select to couple the output terminal of the data driving channel 431_2 to the source line S_2 of the display panel 410 during the scan sub-period TS of the frame period F2.

In light of the foregoing, a time period ΔT can be taken from each time period TL3 (during which each of the gate lines is driven G_1~G_n) in the scan sub-period TS, such that the source driver circuit 430 is able to perform the pre-charging function on all of the pixels of the gate lines in the resultant functional sub-period TF2 (constituted by the total time periods ΔT). After the functional sub-period TF2, In the scan sub-period TS, the source driver circuit 430 correspondingly drives the source lines S_1-S_m of the display panel 410 according to the scan sequence of the gate driver circuit 420, so as to display an image on the display panel 410.

Figure 9:
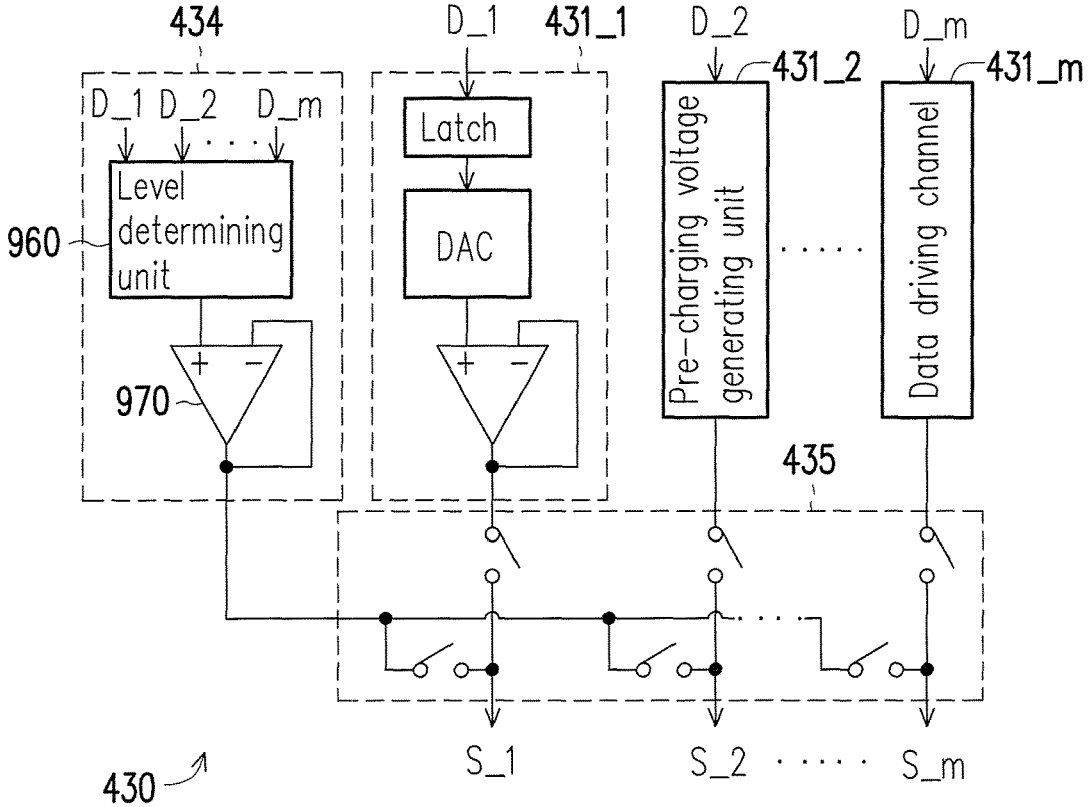
FIG. 9 is schematic block view illustrating the source driver circuit depicted in FIG. 4 according to another embodiment of the invention.

FIG. 9 is schematic block view illustrating the source driver circuit 430 depicted in FIG. 4 according to another embodiment of the invention. The source driver circuit 430 includes a plurality of data driving channels (e.g., the data driving channels 431_1, 431_2, . . . , and **431_*m* shown in FIG. 9). Descriptions of the data driving channels 431_1-431_*m* as shown in FIG. 9 can be deduced from the description of the data driving channel 431_1 as shown in FIG. 8 and thus will be omitted hereinafter. For instance, the data driving channel 431_*m* can latch pixel data D_m, convert the latched data (e.g., the pixel data D_m) into the corresponding pixel voltage, and output the corresponding pixel voltage to the source line S_m of the display panel 410 through the switch circuit 435**.

The pre-charging voltage generating unit 434 is configured to generate a pre-charging voltage and output the same to the switch circuit 435. According to the present embodiment, the pre-charging voltage generating unit 434 includes a level determining unit 960 and an output buffer 970. The level determining unit 960 is configured to receive the pixel data D_1, D_2, . . . , and D_m of the data driving channels 431_1-**431_*m*, dynamically determine and generate pre-charging voltages according to the pixel data D_1, D_2, . . . , and D_m, and output the pre-charging voltages to the output buffer 970. The output buffer 970 is coupled between the level determining unit 960 and the switch circuit 435. The output buffer 970 may contribute to the gain of the pre-charging voltages output by the level determining unit 960 and output said pre-charging voltages to the source lines S_1-S_m of the display panel 410 through the switch circuit 435. Hence, the pre-charging voltages generated by the pre-charging voltage generating unit 434 of the source driver circuit 430 correspond to the latched data of the data driving channels 431_1-431_*m*. In another embodiment of the invention, the pre-charging voltage generated by the pre-charging voltage generating unit 434** may be a fixed voltage.

The switch circuit 435 is coupled between the output terminals of the data driving channels 431_1-**431_*m* and the source lines S_1-S_m of the display panel 410 and coupled between the output terminal of the pre-charging voltage generating unit 434 and the source lines S_1-S_m of the display panel 410. In the functional sub-period TF2 of the frame period F2, the switch circuit 435 may select to couple a plurality of corresponding source lines (e.g., some or all of the source lines S_1-S_m) to the output terminal of the pre-charging voltage generating unit 434. Besides, the switch circuit 435 may select to couple the output terminals of the data driving channels 431_1-431_*m* to the source lines S_1-S_m of the display panel 410 in an one-on-one manner during the scan sub-period TS of the frame period F2**.

According to another embodiment of the invention, the source lines S_1-S_m can be divided into a plurality of groups. In the functional sub-period TF2, the pre-charging voltage generating unit 434 is configured to generate different or identical pre-charging voltages at different times. By applying the time division multiplexing technology, the switch circuit 435 is configured to provide one corresponding group of the groups of the source lines S_1-S_m with the same or different pre-charging voltages output by the pre-charging voltage generating unit 434 at different times. For instance, in a first period of the functional sub-period TF2, the switch circuit 435 is configured to provide the first group of the groups of the source lines S_1-S_m with the pre-charging voltage V1 output by the pre-charging voltage generating unit 434. Here, the pre-charging voltage V1 corresponds to the latch data of one of the data driving channels 431_1-**431_*m* belonging to the first group. In a second period of the functional sub-period TF2, the switch circuit 435 is configured to provide the second group of the groups of the source lines S_1-S_m with the pre-charging voltage V2 output by the pre-charging voltage generating unit 434. Here, the pre-charging voltage V2 corresponds to the latch data of one of the data driving channels 431_1-431_*m*** belonging to the second group.

Figure 10:
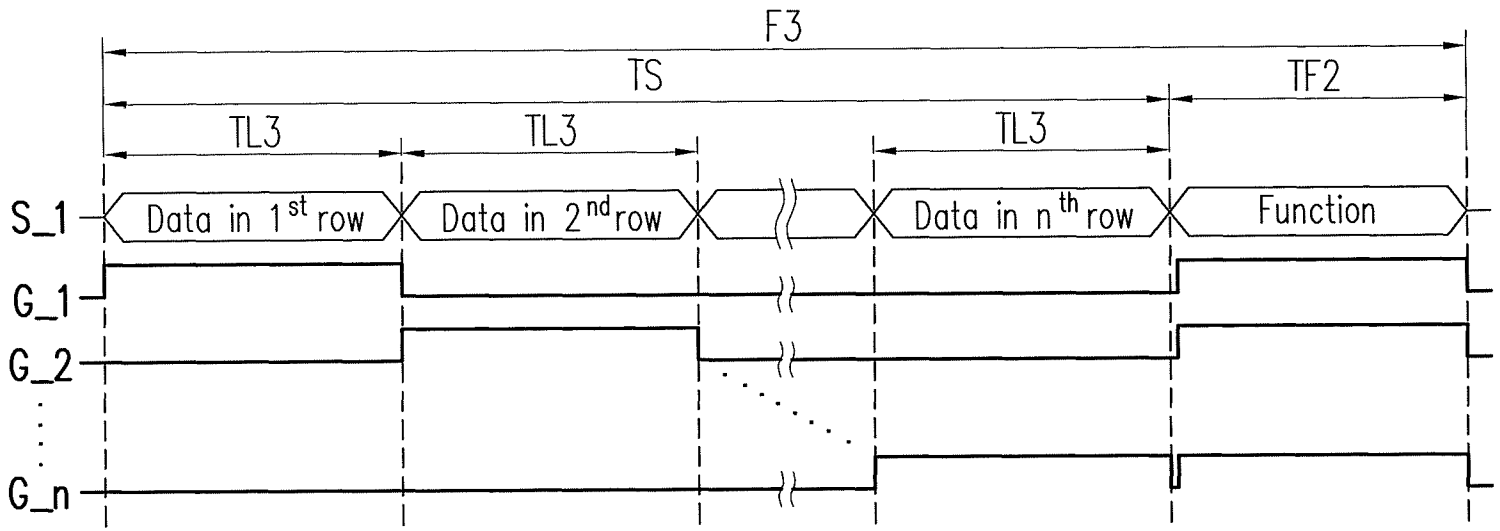
FIG. 10 is a schematic view illustrating waveforms of signals of the display panel depicted in FIG. 4 according to another embodiment of the invention.

FIG. 10 is a schematic view illustrating waveforms of signals of the display panel 410 depicted in FIG. 4 according to another embodiment of the invention. In FIG. 10, the horizontal axis represents time. According to the embodiment shown in FIG. 10, one frame period F3 is divided into a plurality of sub-periods including a functional sub-period TF2 and a scan sub-period TS. In the frame period F3, the functional sub-period TF2 is later than the scan sub-period TS. In the scan sub-period TS of the frame period F3, the gate driver circuit 420 can drive/scan the gate lines G_1-G_n of the display panel 410 according to a certain scan sequence. The description of the scan sub-period TS of the frame period F3 may be deduced from the description of the scan sub-period TS of the frame period F2 as depicted in FIG. 6 and thus will not be provided hereinafter. During the functional sub-period TF2 of the frame period F3, the gate driver circuit 420 simultaneously drives a plurality of gate lines (e.g., some or all of the gate lines G_1-G_n), so as to turn on all of the pixels connected to the gate lines. The description of the functional sub-period TF2 of the frame period F3 may be deduced from the description of the functional sub-period TF2 of the frame period F2 as depicted in FIG. 6 and thus will not be provided hereinafter.

Figure 11:
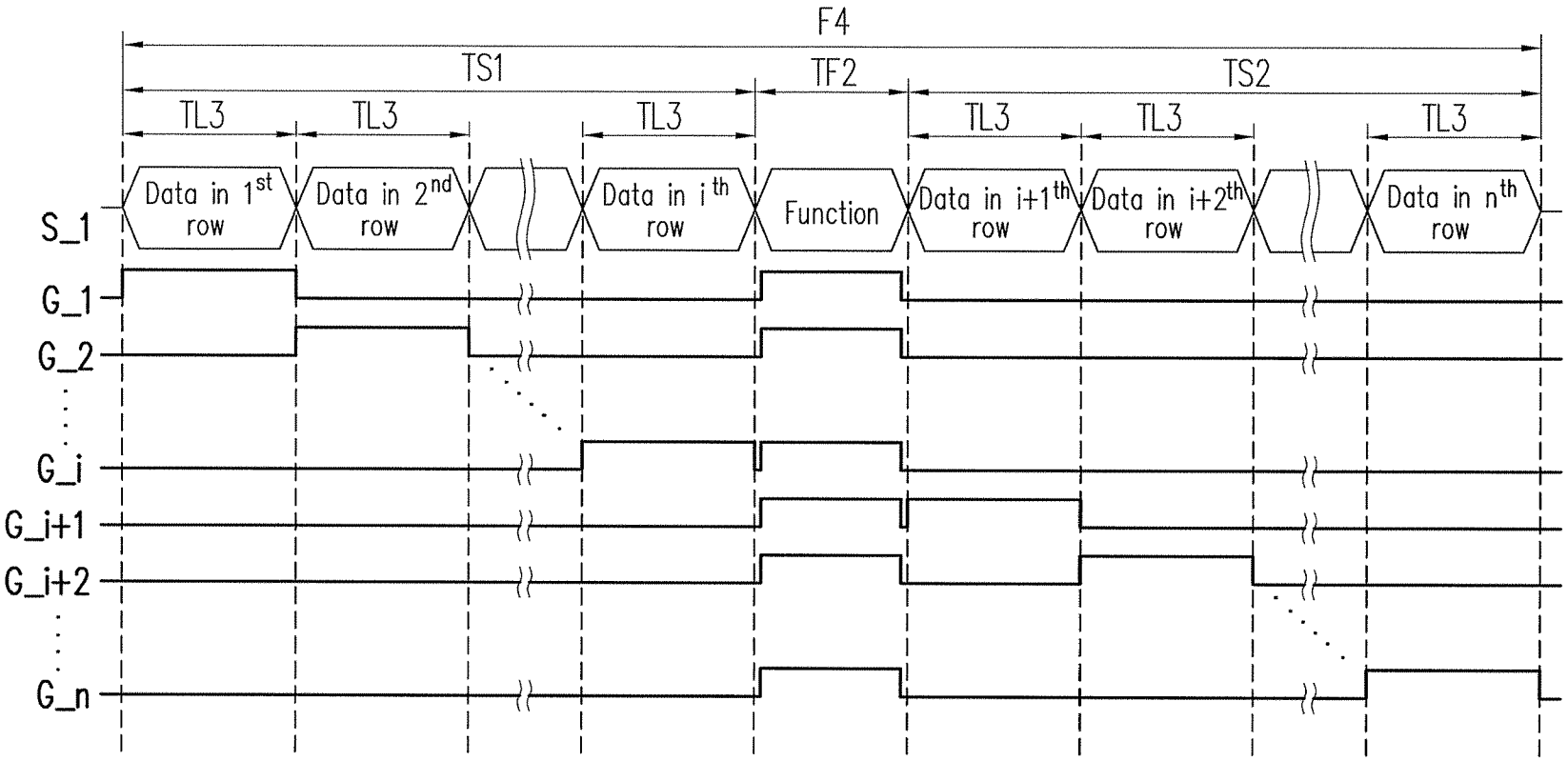
FIG. 11 is a schematic view illustrating waveforms of signals of the display panel depicted in FIG. 4 according to still another embodiment of the invention.

FIG. 11 is a schematic view illustrating waveforms of signals of the display panel 410 depicted in FIG. 4 according to still another embodiment of the invention. In FIG. 11, the horizontal axis represents time. According to the embodiment shown in FIG. 11, one frame period F4 is divided into a plurality of sub-periods including a first scan sub-period TS1, a functional sub-period TF2, and a second scan sub-period TS2. In the frame period F4, the functional sub-period TF2 is between the first scan sub-period TS1 and the second scan sub-period TS2. In the first scan sub-period TS1 of the fame period F4, the gate driver circuit 420 can drive/scan the gate lines G_1, G_2, . . . , and G_i of the display panel 410 according to a first scan sequence. Here, I is a positive integer within a range from 1 to n. The description of the first scan sub-period TS1 of the frame period F4 may be deduced from the description of the scan sub-period TS of the frame period F2 as depicted in FIG. 6 and thus will not be provided hereinafter. During the functional sub-period TF2 of the frame period F4, the gate driver circuit 420 can simultaneously drive a plurality of gate lines (e.g., some or all of the gate lines G_1-G_n), so as to turn on all of the pixels connected to the gate lines; at the same time, the source driver circuit 430 can perform a certain function (e.g., a power-saving function, a pre-charging function, a charge-sharing function, or the like) on different pixels connected to the gate lines. In the functional sub-period TF2, the gate driver circuit 420 can simultaneously drive the gate lines G_1-G_i and the gate lines G_i+1, G_i+2, . . . , and G_n. The description of the functional sub-period TF2 of the frame period F4 may be deduced from the description of the functional sub-period TF2 of the frame period F2 as depicted in FIG. 6 and thus will not be provided hereinafter. In the second scan period TS2 of the frame period F4, the gate driver circuit 420 can drive/scan the gate lines G_i+1-G_n of the display panel 410 according to a second scan sequence. The description of the second scan sub-period TS2 of the frame period F4 may be deduced from the description of the scan sub-period TS of the frame period F2 as depicted in FIG. 6 and thus will not be provided hereinafter.

To sum up, the driving apparatus and the driving method thereof as provided in an embodiment of the invention allow additional functions (e.g., the pre-charging function, the charge-sharing function, and so on) to be simultaneously performed on different pixels connected to the gate lines in the functional sub-period of the frame period, such that the sacrifice of the time spent on charging the pixels is reduced even though the additional functions are performed during the frame period, and that the image contrast and the image quality can both be enhanced.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A display apparatus comprising:

a gate driver circuit, a plurality of output terminals of the gate driver circuit being coupled to a plurality of first gate lines and a plurality of second gate lines of a display panel in an one-on-one manner, wherein the plurality of first gate lines of the display panel is a group of adjacent gate lines, the gate driver circuit simultaneously driving the first gate lines during a functional sub-period of a frame period, so as to turn on a plurality of pixels connected to the first gate lines, the gate driver circuit driving the first gate lines according to a first scan sequence in a first scan sub-period of the same frame period, wherein the functional sub-period is later than the first scan sub-period in the same frame period, wherein the plurality of second gate lines of the display panel is a group of adjacent gate lines, the gate driver circuit is configured to drive the plurality of second gate lines of the display panel according to a second scan sequence in a second scan sub-period of the same frame period, the functional sub-period of the same frame period is between the first scan sub-period and the second scan sub-period in the same frame period; and a source driver circuit, a plurality of output terminals of the source driver circuit being coupled to a plurality of source lines of the display panel in an one-on-one manner, the source driver circuit being configured to drive the source lines during the functional sub-period, so as to perform a function on the pixels connected to the source lines, the source driver circuit correspondingly driving the source lines according to the first scan sequence of the gate driver circuit in the first scan sub-period, so as to display an image;

wherein the gate driver circuit is configured to simultaneously drive the first gate lines and the second gate lines during the functional sub-period.

2. The display apparatus of claim 1, wherein the function comprises a pre-charging function or a charge-sharing function.

3. The display apparatus of claim 1, the source driver circuit comprising:

a data driving channel configured to generate and output a corresponding pixel voltage according to latched data;

a pre-charging voltage generating circuit configured to generate a pre-charging voltage; and a switch circuit, a first input terminal and a second input terminal being respectively coupled to an output terminal of the data driving channel and an output terminal of the pre-charging voltage generating circuit, the switch circuit selects to couple the output terminal of the pre-charging voltage generating circuit to a corresponding source line of the source lines during the functional sub-period and selects to couple the output terminal of the data driving channel to the corresponding source line during the first scan sub-period.

4. The display apparatus of claim 3, wherein the pre-charging voltage corresponds to the latched data.

5. The display apparatus of claim 1, the source driver circuit comprising:

a plurality of data driving channels configured to generate and output a plurality of corresponding pixel voltages according to latched data;

a pre-charging voltage generating circuit configured to generate a pre-charging voltage; and a switch circuit coupled between output terminals of the data driving channels and the source lines and coupled between an output terminal of the pre-charging voltage generating circuit and the source lines, the switch circuit selects to couple a plurality of corresponding source lines of the source lines together to the output terminal of the pre-charging voltage generating circuit in the functional sub-period and selects to couple the output terminals of the data driving channels to the corresponding source lines in an one-on-one manner.

6. A driving method of a display apparatus, comprising:

simultaneously driving a plurality of first gate lines of a display panel in a functional sub-period of a frame period, so as to turn on a plurality of pixels connected to the first gate lines, wherein the display panel comprises a plurality of first gate lines and a plurality of second gate lines, the plurality of first gate lines of the display panel is a group of adjacent gate lines, and the plurality of second gate lines of the display panel is a group of adjacent gate lines;

driving a plurality of source lines of the display panel in the functional sub-period, so as to perform a function on the pixels connected to the first gate lines;

driving the first gate lines sequentially during a first scan sub-period of the same frame period according to a first scan sequence, wherein the functional sub-period is later than the first scan sub-period in the same frame period;

driving the plurality of second gate lines of the display panel during a second scan sub-period of the same frame period according to a second scan sequence, wherein the functional sub-period of the same frame period is between the first scan sub-period and the second scan sub-period in the same frame period;

correspondingly driving the source lines according to the first scan sequence in the first scan sub-period, so as to display an image; and simultaneously driving the first gate lines and the second gate lines in the functional sub-period.

7. The driving method of claim 6, wherein the function comprises a pre-charging function or a charge-sharing function.

* * * * *